United States Patent [19]

Cloudy et al.

[11] Patent Number: 4,584,849

[45] Date of Patent: Apr. 29, 1986

[54] FOOD FREEZING TUNNEL

[75] Inventors: Westley R. Cloudy; Robert E. Britton, both of Edmonds; Anthony D. Snodgrass, Everett, all of Wash.

[73] Assignee: Cloudy & Britton, Inc., Mountlake Terrace, Wash.

[21] Appl. No.: 692,291

[22] Filed: Jan. 17, 1985

[51] Int. Cl.[4] ..... F25D 25/04

[52] U.S. Cl. ..... 62/380; 62/303

[58] Field of Search ..... 62/63, 266, 380, 381, 62/303

[56] References Cited

U.S. PATENT DOCUMENTS

| | | | |
|---|---|---|---|
| 3,226,947 | 1/1966 | Wakatsuki et al. | 62/303 |
| 3,393,532 | 7/1968 | Khoylian | 67/380 |
| 3,914,953 | 10/1975 | Miller | 62/380 |
| 3,938,350 | 2/1976 | Martin et al. | 62/380 |
| 4,062,202 | 12/1977 | Cloudy | 62/380 |
| 4,078,398 | 3/1978 | Cloudy | 62/380 |
| 4,164,129 | 8/1979 | Stueber | 62/303 |

*Primary Examiner*—Ronald C. Capossela
*Attorney, Agent, or Firm*—Roy E. Mattern, Jr.

[57] ABSTRACT

In an improved food freezing tunnel, a freezing airflow apparatus, as disclosed in U.S. Pat. No. 4,078,398, is further improved and rearranged in respect to the vertical in-line alignment of the freezing coils, the fans, and the food product porous conveyor, all of which are positioned in the upwardly flowing airflow. The air to be cooled enters at the bottom of the tunnel via an inlet air chamber, as before, and then is first drawn through the freezing coils of the freezing chamber before passing upwardly through the fan intakes into the fan chamber. Upon leaving the fans rotating about vertical axes, the freezing air flows radially and horizontally, as before. Then, vertical baffles spaced about each fan, modify this discharging airflow to prevent any excessive swirling or vortexing of the freezing airflow passing upwardly from the fan chamber through the moving food product porous conveyor. During freezing operations, the bottom entering return air in passing through the freezing coils, is dried sufficiently, so no frost or ice forms on the fans, which would otherwise cause unbalancing of the fans, in turn resulting in a shut down period to defrost the fans. There are easily removed pullout perforated plates, horizontally positioned just below the moving cold porous conveyor, which is carrying the food product being frozen.

13 Claims, 6 Drawing Figures

FIG. 3
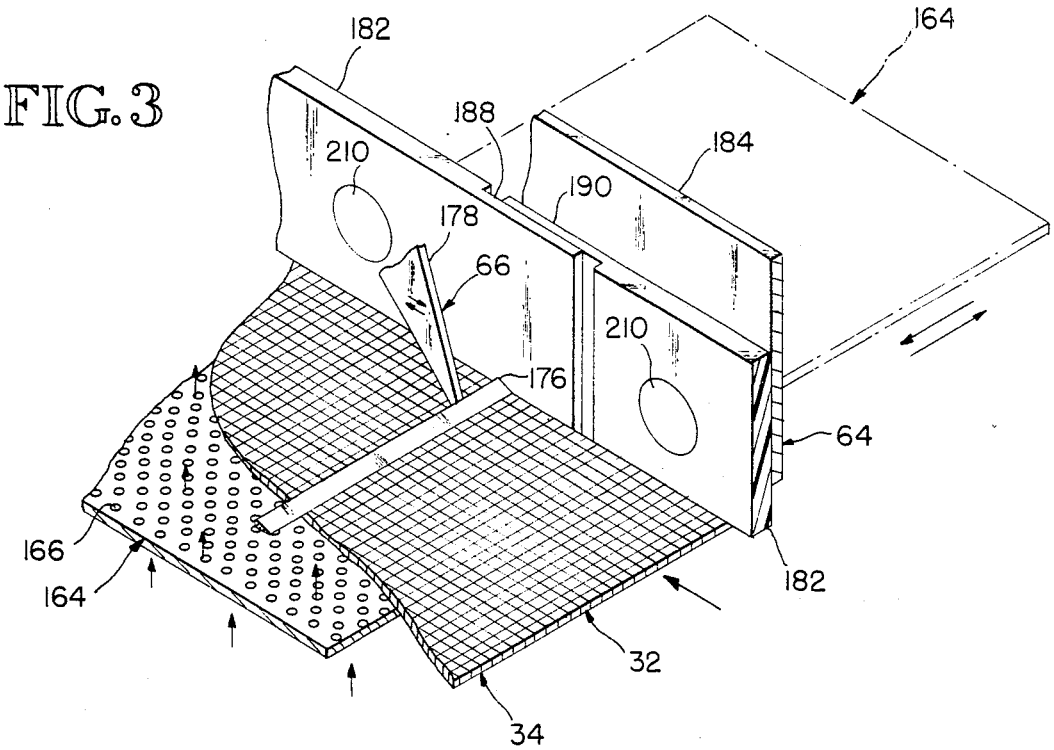
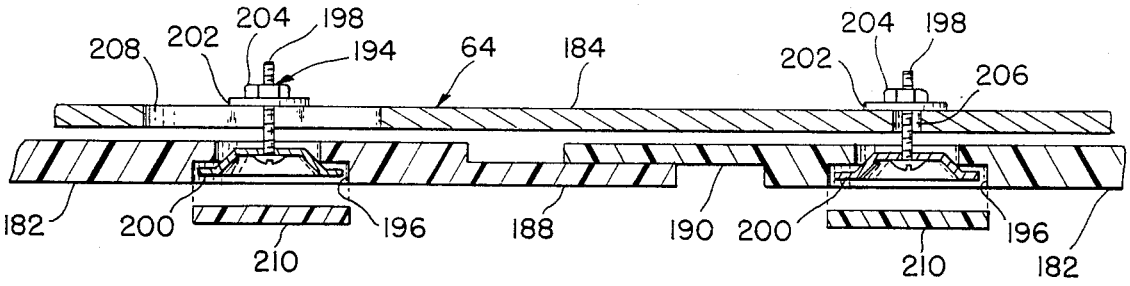
FIG. 4

FIG. 5
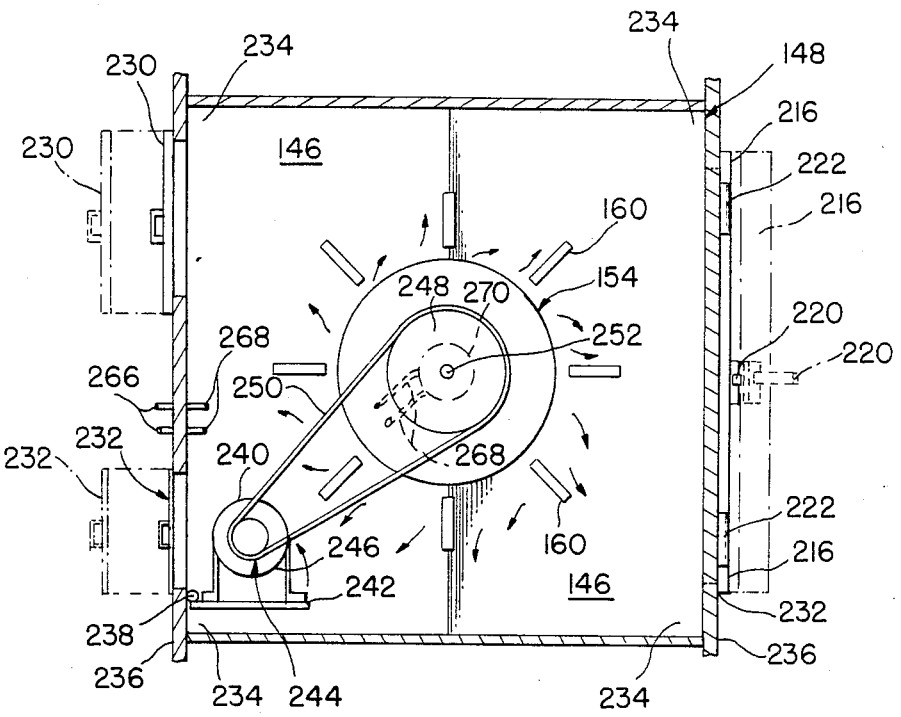
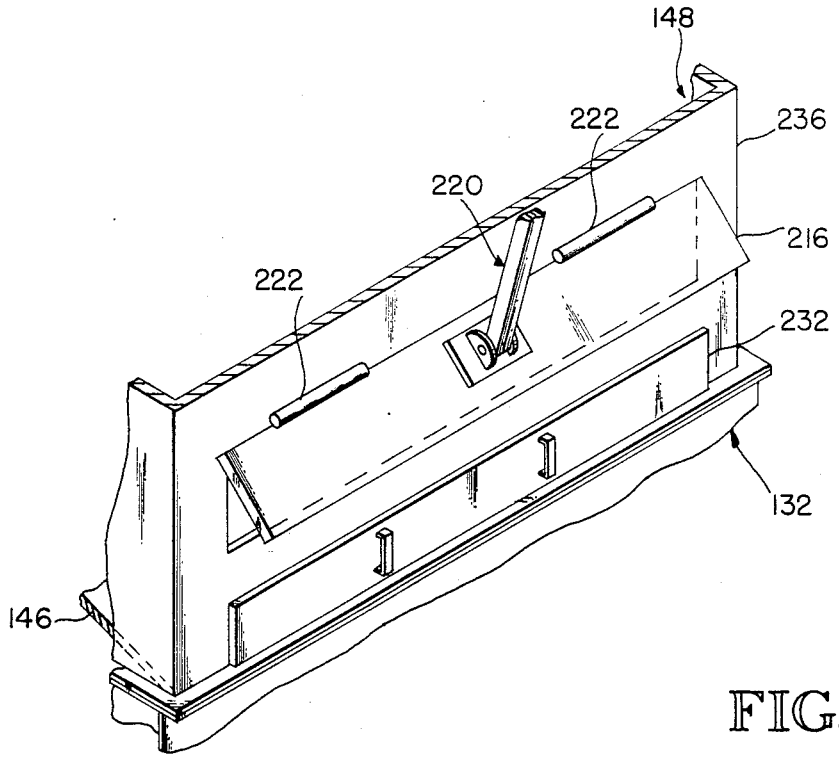
FIG. 6

FOOD FREEZING TUNNEL

BACKGROUND OF THE INVENTION

As illustrated and described in U.S. Pat. No. 4,078,398, the food freezing tunnel has an improved airflow apparatus, wherein an unhoused centrifugal fan wheel, without a volute, or shroud, is mounted with its axis vertically positioned, so it discharges air radially in horizontal directions, to be subsequently redirected upwardly. This fan arrangement is spaced above the floor of the freezing tunnel, and then vertically above, the side by side freezing coils are positioned. Both the food carrying ever changing run and the return ever changing run of the porous conveyor are vertically aligned above the freezing coils. This floor space saving and excellent freezing airflow, food freezing tunnel continues to effectively freeze food products being delivered to the porous food conveyor. However, the further improvements illustrated and described herein have increased operational times, before complete tunnel defrosting periods and/or module defrosting periods must occur. Also electrical motors and their drives are selectable from those offered at lower cost, and they are operated longer, before more convenient inspection, service, and/or replacement must be undertaken. Moreover, the freezing coils stay clean, as food product residues are collected and disposed of above the locations of the freezing coils, thereby adding to the length of the operation times before shutdowns for cause or for inspection must be undertaken.

SUMMARY OF THE INVENTION

While keeping the improved airflow advantages and floor space economy of the food freezing tunnels manufactured and operated, as illustrated and described in U.S. Pat. No. 4,078,398, a further improved food freezing tunnel is illustrated and described herein, which continues to freeze food products quickly, individually, and consistently. However in doing so, this improved food freezing tunnel operates longer between down times. When they do occur, they are much shorter in duration, as food debris clean outs, service, repairs, and replacements, are more conveniently undertaken.

The returning air flows in continuous 360 degree cycles passing down the outside of the fan chamber or plenum, passing down the outside of the freezing coil chamber, and continuing within this circulating volume also defined by the interior walls of the surrounding insulated structure. Then continuing the 360 degree cycles, the returning air enters an air intake volume or lower inlet air chamber located between the floor of the insulated structure and the bottom of the freezing coil chamber. The quantity, the regularity, and the impulsing of this returning air in some embodiments is controlled by pivoting doors or vanes positioned in side skirts defining a chamber for this air intake volume. Also airflow control doors are placed at other locations.

The returning air, then having changed direction in the air intake volume or lower inlet air chamber commences flowing upwardly, first passing through the freezing coils in the freezing coil chamber, then being drawn into the fan chamber and discharged therefrom via the operation of the fan, and thereafter passing up through the porous conveyor to effectively, quickly, consistently, and individually freeze the individual food products during the fluidization, before turning and returning downwardly during these 360 degree air cycles. To insure the freezing of individual food products, in selected embodiments, a food vibratory weir assembly is used, as disclosed in U.S. Pat. No. 4,062,202.

The returning air in passing upwardly through the freezing coils is effectively dried, so frost and/or ice will not collect on the fan blades. No longer is there any need to shut down a uni-section, a module, or the whole freezing tunnel, to remove ice that is causing an unbalanced fan operation. There are easily removed pullout perforated plates which serve by helping in the pressurization of the fan chamber and distributing the upward flow of the freezing air through the porous conveyor belt. Vertical vanes radially spaced about the circumferential discharge volume adjacent to the rotating fan blades, break up any swirling flows of the freezing air enroute to the porous belt, often a mesh belt, of the conveyor moving the food product during the freezing operations.

Any food product in very small sizes and/or in debris proportions dropping through the porous conveyor belt, against the airflow, first partially collects on the easily removed pullout perforated plates, horizontally positioned just below the moving cold porous conveyor. Then most of the very small size food product or food debris passing through these pullout perforated plates is thereafter intercepted on fan decks, which radially and horizontally extend around each inlet cone of each fan. This food product and food debris remains on the fan decks until taken out of an access door. Importantly and consequently, no food product or food debris enters the freezing coil chamber to destroy the effectiveness of the freezing coils, or to require the cleaning of the coils to remove any dropped food particles.

Other important improvements include electric motors with their changeable speed V-belt and pulley drives, with the motors being conveniently mounted outside the fan chamber, for conveniently servicing them. Also the electric fan motors, in some embodiments, are hinged mounted for operation inside of a fan chamber, and to be swung outside the fan chamber, via an entry door, for servicing, repair, and/or replacement. There are external grease fittings with communicating passageways to inside parts needing lubrication, such as the bearings for the rotating fans. Product loss guards have horizontal plastic runners positioned under the edges of the moving stainless steel mesh belt, serving as the horizontal guides of the porous conveyor, and vertical plastic sections, overlapping for expansion and contraction, while keeping the fluidized food products both on and over the moving porous conveyor.

The returning porous conveyor is washed, dried, and passed by an auger to remove any food debris from the stainless steel mesh belt. Thereafter the mesh belt is guided upwardly to the freezing level and returned for horizontal travel through the food freezing tunnel, being powered by driven sprockets located at the discharge end of the freezing tunnel.

Preferably, the food freezing tunnel is composed of uni-sections or modules, and these are preferably arranged so defrosting may be undertaken sequentially, leaving other uni-sections in operation, as a particular uni-section is being defrosted and/or serviced in some way. To effect such sequential defrosting a continuous drain pan chamber with respective dampers and respective outlets, is utilized keeping fog and steam from going into an adjacent uni-section. Moreover, the returning run of the food product porous conveyor is positioned below the continuous drain pan chamber, thereby being kept clear of defrosting moisture, so the overall food product freezing operations may be continued.

Safe, quiet, food product freezing tunnels are provided to operate over longer running times with greater efficiency, and steadier airflows, which keep the food product fluidized but not flying. Also as necessary, the movable vibrating wier is conveniently operated at any selected location along the food product line of this improved food freezing tunnel.

DESCRIPTION OF DRAWINGS

This improved food freezing tunnel in various embodiments is illustrated in the drawings, wherein:

FIG. 3 is a partial isometric view, with many portions broken away, to illustrate: the placement and removal of the perforated plate just below the porous belt conveyor, the selectable longitudinal placement of the food vibratory weir, the securement of longitudinally expandable and contractable sections of longitudinal and upright plastic guards with their metal backing, which keep the food products over the porous conveyor, with respective motion arrows indicating the upward freezing air flows, the vibrations of the food product weir, the removal of the perforated plate, and the direction of the porous conveyor;

FIG. 4 is a sectional view looking down on the overlapping joint of the longitudinally expandable and contractable sections of the upright plastic guards, indicating how one end of each section is securely fastened and the other end of each section is slidably fastened, with each fastener assembly including a fill-in plastic cover or plug, to continue the full presentation of a plastic surface of these upright plastic guards to the food products being fluidized while they are being frozen;

FIG. 5 is a top view of the fan chamber below the perforated plate, with some portions not shown, and phantom lines indicating the movement of parts, to illustrate: the placement of the baffles about the fan, the V. belt and pulley drive for a fan, the other electric fan motor location, when this fan motor is hinged mounted for operation inside a fan chamber, and to be swung outside the fan chamber, via an entry door, for servicing, repair and/or replacement, and an access panel for cleaning and inspection, a food product residue clean out door, and a hinged air control door, which is used in pulsing the pressurized fan air and also in regulating and turning the flow of this pressurized fan air, i.e. the food freezing air, passing up through the porous conveyor belt; and FIG. 6 is a partial isometric view of some of the lower outside portions of a fan chamber, to illustrate a portion of the fan deck, which radially and horizontally extends around each inlet cone of each fan, forming a continuous bottom, which collects the food product residues, where they are conveniently cleaned out, after the removal of a clean out door, and to show how a hinged airflow door is used to fine tune and/or create air impulses in reference to the effective freezing airflows leaving upwardly from the fan chamber to pass through the perforated plate and on through the porous conveyor, in turn carrying the food products being individually frozen.

DESCRIPTION OF THE PREFERRED EMBODIMENTS

Figure 1:
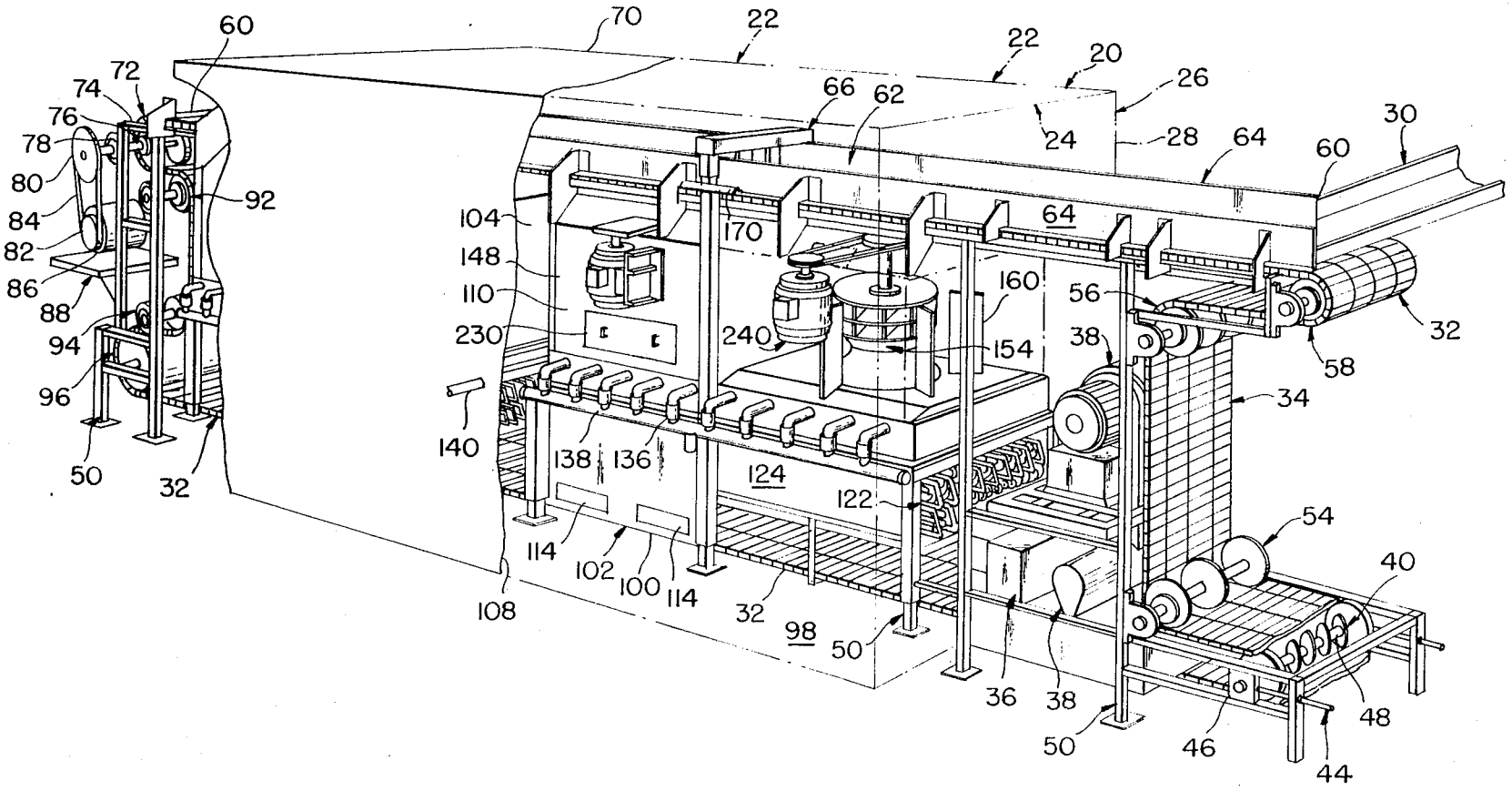
FIG. 1 is an isometric view of a preferred embodiment of the improved food freezing tunnel, as viewed from the food product loading end, which also serves as the porous conveyor belt cleaning and adjustment end, indicating, via broken lines, and removed portions for illustration purposes, how uni-sections or modules are arranged longitudinally and vertically in-line to provide a freezing tunnel of a specified length, in respect to positioning these uni-sections within an insulated enclosure constructed within a factory building, which is not shown, and also showing some of the portions of a vibratory weir, the porous conveyor driving assembly, and the entry doors of one of the air inlet chambers.

An improved food freezing tunnel in preferred embodiments continues the freezing airflow pattern disclosed in U.S. Pat. No. 4,078,398, with different arrangements of the vertical in-line components and their chambers, thereby obtaining longer operating times before defrosting and servicing, and effectively continuing operations, while only one portion, module, or uni-section of the food freezing tunnel is withdrawn from a freezing operation. A preferred embodiment is illustrated in FIG. 1 where an improved food freezing tunnel 20 is arranged in several uni-sections 22 or modules aligned longitudinally in the central volume 24 of an insulated enclosure 26.

The Arrangement of the Conveyor Outside and Inside the Food Freezing Tunnel

On the entry end 28 of the freezing tunnel 20, the food product, not shown, is delivered from a preparation product line by conveyor 30 and dropped on to the porous conveyor belt 32 of the conveyor 34 of the food freezing tunnel 20. At this location, this porous conveyor belt 32 is still outside the insulated enclosure 26, having been cleaned by passing under a washing unit 36, a drying unit 38, and scraped clean by an auger 40. At this entry end 28, the porous conveyor belt 32 is also tightened by using the screw adjustment conveyor belt tightening assembly 44. It utilizes the slidably positioned bearings 46 and axle 48. The latter, as shown, being the axle of the cleaning auger 40, which revolves, as the porous conveyor belt 32 passes partially around it during a directional change. At this location and elsewhere throughout the food freezing tunnel 20, supporting frame members 50 are used, where necessary, and in some views they are not shown, in order to more clearly show other portions of the food freezing tunnel 20.

After porous conveyor belt 32 has been cleaned and dried, kept tightened, and changed in its horizontal direction, its direction is further changed by sprocket assembly 54 to move vertically upwardly to reach sprocket assembly 56. This sprocket assembly 56 and sprocket assembly 58 serve to present the porous conveyor belt 32 for food product loading, below the exit end 60 of the preparation conveyor 30, shown only at this location, which is bringing a food product, such as french fries, not shown, to be frozen.

Thereafter the food products are moved through food freezing tunnel 20 passing within the insulated enclosure 26, traveling throughout the combined conveyor chambers 62 of the uni-sections 22, while kept in position by the food product guard assemblies 64 during their fluidization. At a selectable longitudinal location a vibratory weir assembly 66 is positioned to separate any foods still stuck together, as these foods commence their fluidization and their freezing. This vibratory weir is further illustrated and described in U.S. Pat. No. 4,062,202.

During the freezing operations and all during the operations of the porous conveyor belt conveyor 34, the porous conveyor belt 32 is being driven, at the discharge end 70 of the food freezing tunnel 20, by powered sprocket assembly 72, inclusive of the sprockets 74, shaft 76, bearings 78, large pulley 80, small pulley 82, drive belt 84, electric motor 86, and support bracket 88, secured to a frame member 50.

At this food product discharge end 70 of the food freezing tunnel 20, the conveyor 34 is extended sufficiently outside of the insulated enclosure 26 to deliver the frozen food products to other conveyors or containers, not shown. This extension, and subsequent directional changes are undertaken, for example, by using powered sprocket assembly 72, and other selected and positioned sprocket assemblies, such as the three sprocket assemblies 92, 94, and 96. They are shown being used to guide the porous conveyor belt 32 back down alongside the insulated enclosure 26, and then redirecting the porous conveyor belt 32 for a return run traveling back just above the floor 98 and just below the drain pan bottoms 100 of the lower inlet air chambers 102.

The Vertical In-line Arrangement of the Chambers of Each Uni-Section or Module of the Food Freezing Tunnel and the Changing Directions of the Cycling Air Flow As illustrated in FIG. 1, the food freezing tunnel 20 is preferably made to meet various overall food product freezing requirements by placing a selected number of uni-sections 22 in longitudinal alignment within an insulated enclosure 26. Then in relation to specific overall embodiments, the uni-sections 22 are made in specifically selected embodiments. One of these preferred uni-sections 22 is illustrated in the sectional view of FIG. 2. The returning air passing downwardly in the respective side volumes 104, 106, located between the inside walls 108 of the insulated enclosure 26 and all the outside portions 110 of the vertical in-line chambers, completes this downward air passage, by turning and entering the returning air inlet doors 114 of the lower inlet air chamber 102. These inlet doors 114, are opened and shut by operation of an actuator 116 and the linkage assembly 118, and they essentially remain open during the freezing operation of a uni-section 22. However, they are closed during a defrosting operation of a uni-section 22. By closing these inlet doors 114 and making other similar arrangements, sequential defrosting is undertaken more conveniently and more effectively. To some extent, the degree of opening of these inlet doors 114 is managed to control and to tune the overall airflow through the respective uni-section 22 of this food freezing tunnel 20.

Upon leaving the lower inlet air chamber 102, the air flows upwardly by the refrigerant coils 122 of the freezing chamber 124, which is located vertically in line above the lower inlet air chamber 102. The refrigerant enters through conduit 126 and exits through conduit 128.

Upon leaving the freezing chamber 124, the freezing temperature air flows upwardly through the inactive defrosting chamber or section 132, passing by the defrosting water sprayers 134 positioned on, below, and across an inside defrosting water pipe 136, in turn connected outside of the defrosting chamber 132 to a longitudinal manifold pipe 138, ready to receive warm water during defrosting, from water inlet pipe 140.

Figure 2:
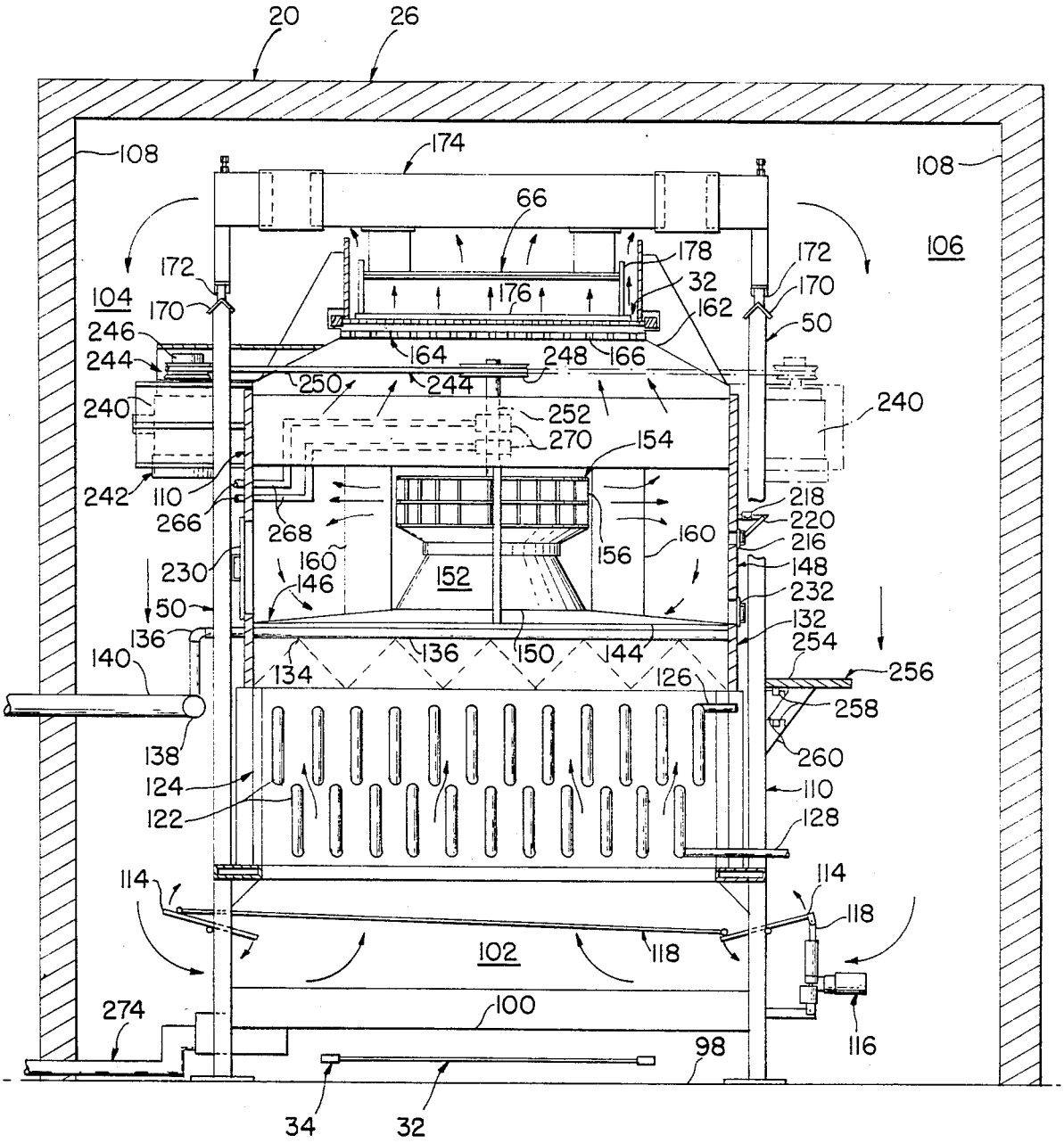
FIG. 2 is a cross section taken through one of the uni-sections or modules, illustrated in FIG. 1, illustrating the vertical in-line centered arrangement of a fan chamber located below the food product conveying porous mesh belt, and a removable perforated plate, which serves in pressurizing the fan chamber, a fan deck, which also serves to collect food debris, and the freezing coils and their chamber located below the fan deck, and fan entry of the fan chamber, which are all arranged to leave space below the both the returning air chamber, which has pivotable entry doors and continuous drain bottom, and for the returning run of the food product conveying porous mesh belt traveling below the returning air chamber, and also showing the selective longitudinal placement of the food vibratory weir.

Upon leaving the defrosting chamber 132, the upwardly flowing freezing temperature air, well dried upon passing through the freezing chamber 124, is guided by the bottom formed surface 144 of the fan deck 146 of the fan chamber 148 to reach the entry 150 of the fan intake 152. This freezing temperature air is drawn upwardly on through the fan 154 and then discharged radially, tangentially and horizontally, from the impeller 156, as illustrated in FIGS. 2 and 5. Eight radially spaced vertical baffles 160 help in eliminating the tangental flow component of this radially and horizontally discharging freezing air, to thereby eliminate any swirling or vortexing of this freezing air, which after pressurizing the fan chamber 148, continues flowing upwardly to the top of the fan chamber 162, which is capped by a pull out perforated plate 164. This plate 164 helps in the pressurization of the fan chamber 148. Its many holes 166 serve in distributing the upwardly flowing freezing air, as this air passes upwardly through the moving porous conveyor belt 32, carrying the food products, not shown, being frozen, to accomplish their successful freezing in this food freezing tunnel 20.

At a selectable location, indicated in FIGS. 1, 2 and 3, a vibratory weir assembly 66, as further illustrated and described in U.S. Pat. No. 4,062,202, is positioned to completely separate food products, which otherwise might tend to remain stuck together, even though all the food products are undergoing fluidization in the freezing airflow, which is passing upwardly through the conveyor chamber 61. As indicated in FIG. 1, at the top of frame members 50, a track 170, shown only in part, is positioned, and wheels 172 are secured to an overhead frame 174, making it possible to longitudinally position the vibratory weir assembly 66, which is supported by the overhead frame 174. In FIG. 3, the food weir 176 of the vibratory weir assembly 66, is shown in position, being held by depending legs 178 of the vibratory weir assembly 66.

The freezing air after passing upwardly through the porous conveyor belt and freezing the food product continues flowing upwardly. However, this freezing airflow soon changes direction and commences the return airflows, as shown by the directional airflow arrows presented in FIG. 2, and thereafter the airflow cycle is repeated.

The Food Freezing Tunnel Components Nearby the Conveyed Food Products

The partial view of FIG. 3 shows the porous conveyor belt 32 of the porous belt conveyor 34, where this belt 32 is passing below the food weir 176 of the vibrating weir assembly 66, and over the pull out perforated plate 164. Airflow directional arrows show how the pressurized freezing air passes upwardly through the holes 166 in this perforated plate 164, which is helping in the pressurization of the fan chamber 148. The food products, not shown, are prevented from leaving the conveyor 34 sideways, by the plastic guard sections 182, having their overlapped expandable, contractable sections 182, so secured to a respective metal backing guard panel 184, forming food product guard assemblies 64, which extend throughout the porous belt conveyor 34, where the food products are being conveyed.

These expandable, contractable plastic guard sections 182 overlap with longitudinal clearances, as illustrated in FIGS. 3 and 4. The transverse clearances shown in FIG. 4 are only for illustrative purposes, indicating the assembly of the guard sections 182. Each plastic guard section 182 has overlappable tongue portions 188, 190 at their respective ends, which upon the joining of one section 182 to another section 182, slidably fit alongside one another, as shown in FIGS. 3 and 4, to complete an overlapping, so a plastic surface is always adjacent the conveyed fluidized food products.

In FIG. 4, a fastener assembly 194 is shown to the right, which fits a recess 196 in the plastic guard section 182. The assembly 194 has a bolt 198, a large dish shaped head washer 200, a circular nut washer 202, and a nut 204. At this right side area of FIG. 4, the bolt 198 is passed through a restrictive hole 206 drilled in the backing guard panel 184. Therefore at this location the plastic guard section 182 remains longitudinally in place adjacent the backing quard panel 184. However, at the left side area of FIG. 5, the bolt 198 is passed through a horizontally elongated restrictive slot 208 cut in the backing guard panel 184. Therefore at this location the plastic guard section 182 is restrictively free to longitudinally move relative to the backing guard panel 184 during temperature changes. After the securement of the respective fastener assemblies 194, the respective filler plugs 210 are placed over the dish shaped head washer 200, to continue the overall plastic surface, which confronts the passing food products. Because of the temperature range experienced by these plastic guard sections and the knowledge of their coefficients of expansion and contraction, this assembly and securement configuration is used, as shown in FIG. 4.

Additional Control of the Airflow by Opening, Adjusting and Closing Airflow Doors in the Fan Chamber, and by Using the Baffles Around the Fan Previously in reference to FIGS. 1 and 2 airflow inlet doors 114 of the lower inlet air chamber 102 were said to be used in airflow control. Also, as shown in FIGS. 2, 5 and 6, airflow outlet doors 216 are moved by respective actuators 218 and linkages 220 about hinges 222. Movement of these hinged airflow outlet doors 216 help in the fine tuning of the pressurized freezing airflow passing upwardly through the perforated plate 167 and on through the porous belt conveyors 34. Also their rapid cycling from closed to opened positions creates a pulsing of the pressurized freezing airflow, which is effective in distributing the food products more evenly throughout the porous conveyor belt 32. As shown in FIG. 5, the eight radially spaced vertical baffles 160 eliminate any tendency of the freezing airflow to swirl as this airflow deposits from the fan chamber 148.

Removable Access Panels and the Clean Out Doors, and Accessible Electric Motors With V. Belt Drives, and Grease Fittings, Cat Walk, All Help to Reduce the Service Times As shown in FIGS. 2 and 5, there are removable access panels 230 used during inspections and during cleaning. As shown in FIGS. 2 and 6, there are removable doors 232 used during inspections, occasionally used for airflow tuning, and often used to clean out food product debris. As shown in FIG. 6 the food product debris, not shown, collects where the fan deck 146 of the fan chamber 148 terminates in the space 234 along the side 236 of the fan chamber.

Electric fan motors 240 are preferably mounted on one selected side of the fan chamber 138 on a support 242 as shown in FIG. 2. A V. belt drive 244 is selected to drive the shaft 252 of fan 154, with the motor and fan pulley wheels 246, 248 and belt 250 being selectable and/or changeable to obtain the rotating speeds which are specified.

Also the electric fan motors 240, in some embodiments, as shown in FIG. 5, are mounted on hinges 238 for operation inside a fan chamber 148, and to be swung outside the fan chamber, via an entry door 232, for servicing, repair, and/or replacement.

A section 254 of a catwalk 256 is equipped with wheels 258 and mounted on longitudinal upper and lower rails 260 forming a track, as shown in FIG. 2. This catwalk section 254 is longitudinally moved to selected locations, where observations of the fluidized food product tunnel freezing operations are undertaken.

Throughout the food freezing tunnel grease fittings 266 are used, and as necessary conduits 268 are used to guide grease, for example to bearings, such as the fan shaft bearings 270.

As indicated by the phantom lines in FIG. 2, the electric fan motor 240 could be located on the opposite side of the fan chamber 148. Also the sides of the fan chamber 148 are interchangeable, thereby making the interchange from side to side, conveniently possible, during assembly or subsequently, of other facilities such as the access panels 230 and the removable doors 232.

Preferably during defrosting of the individual unisections 22, the water collecting in the drain pan bottom 100 is drained through conduit 274, which extends outside the insulated enclosure 26, as shown in FIG. 2.

All these arrangements of components, chambers and parts, collectively assist in servicing this food freezing tunnel for comparatively much shorter time periods and at less frequent time periods, while still performing an excellent and economical food product freezing operation. As discussed previously the airflow is kept drier to increase the operating times before stopping to remove frost and ice from the fan chamber. Also the food product and food product debris are kept clear of any entry into the freezing coil chambers, eliminating the need for this type of cleaning period.

We claim:

1. An improved food freezing building structure and inside food freezing tunnel utilized to freeze unpackaged individual food portions occupying a limited floor area in utilizing efficiently a uniform flow of freezing air moved by an unhoused centrifugal fan wheel mounted with its axis vertically positioned within the freezing tunnel and located above the freezing coils and located below a porous conveyor on which the individual food portions are traveling, and with the freezing coils being protected from dropping food portions by a bottom of the unhoused centrifugal fan, comprising:

(a) a food freezing building structure having respective interior walls;

(b) a food freezing tunnel mounted within the food freezing building structure creating return downwardly flowing air passageways between the respective interior walls of the food freezing building structure and the food freezing tunnel;

(c) a lower inlet air chamber in the bottom of the food freezing tunnel to receive and to turn the returning air;

(d) a freezing coil chamber and freezing coils mounted therein positioned above and in-line with the lower inlet air chamber within the freezing tunnel to receive, drop the temperature and dry the circulating air, creating a uniform freezing airflow passing upwardly to an intake of an unhoused centrifugal fan, with this freezing airflow being dry enough so there is no frost and ice buildup on this fan or in a chamber of the fan;

(e) a defrost chamber mounted above and in-line with the freezing coil chamber having hot water spray system which, during defrosting of the freezing coils heats both this defrost chamber and the freezing coil chamber to remove the ice and frost from the freezing coils and the defrost chamber;

(f) a fan chamber in the food freezing tunnel to receive the returning upwardly flowing freezing air from the defrost chamber and the freezing coil chamber, being positioned above and in-line with the freezing coil chamber;

(g) an unhoused centrifugal fan wheel mounted centrally in the fan chamber with its axis vertically positioned and having a bottom intake to receive the upwardly flowing freezing air from the defrost chamber and the freezing coil chamber and to discharge the freezing air in a horizontal direction in the fan chamber;

(h) a bottom of the fan chamber surrounding the bottom intake of the unhoused centrifugal fan wheel serving to guide the freezing air leaving the defrost chamber and the freezing coil chamber into this bottom intake of the unhoused centrifugal fan wheel, and also serving to collect and to divert any food portions, so no food portions will ever enter the freezing coil chamber during the operation of the freezing tunnel;

(i) complete side walls of the fan chamber which with the bottom of the fan chamber redirect upwardly the freezing air leaving the unhoused centrifugal fan wheel, and which with the bottom of the fan chamber serve to reduce the noise level of the operating centrifugal fan wheel, and which with the bottom of the fan chamber serve to keep the operating centrifugal fan wheel from causing personnel injuries;

(j) a fan motor supported on the side walls of the fan chamber outside of the fan chamber;

(k) a drive belt system mounted on and between the fan motor and the unhoused centrifugal fan wheel;

(l) radially spaced vertical baffles mounted on the bottom of the fan chamber around the unhoused centrifugal fan wheel, which eliminate any possible continuing tangential flow component of the radially and horizontally discharging freezing air to thereby eliminate any swirling or vortexing of this freezing air which is pressurizing the fan chamber;

(m) a top of the fan chamber having pull out perforated plates which help in the pressurization of the fan chamber and in distributing the upwardly flowing freezing air, and in collecting food portions;

(n) a porous conveyor belt chamber positioned above and in-line with the fan chamber to first direct the upwardly flowing freezing air through a moving porous conveyor, and then to exit this freezing air flow for its return downwardly in the downwardly flowing air passageways between the respective interior walls of the food freezing building structure and the food freezing tunnel;

(o) a porous conveyor belt and driving assembly of the freezing tunnel, having a top run of the porous conveyor belt moving in the porous conveyor belt chamber and receiving food portions and carrying them over the top of the fan chamber, so the freezing air moving uniformly upwardly through the perforated plates will pass by and around the individual food portions to effectively freeze them, and having a bottom run of the porous conveyor belt moving below the lower inlet air chamber; and (p) small air flow control doors having operating mechanisms located in the fan chamber just above the bottom of the fan chamber, which when opened direct freezing airflow out of the freezing tunnel thereby reducing the upwardly flowing freezing airflow through the porous conveyor belt moving the food portions, without changing the static pressure directly under the porous conveyor belt and without interfering with the perfect fluidization of the food portions during their freezing while traveling on the porous conveyor belt.

2. An improved food freezing building structure and inside food freezing tunnel, as claimed in claim 1, having clean out doors located at the bottom of the fan chamber to remove the collected food and food debris.

3. An improved food freezing building structure and inside freezing tunnel, as claimed in claim 2, having larger side panels and smaller side doors for selective and interchangeable placement on the right and left sides of the fan chamber, the freezing coil chamber, and the lower inlet air chamber, whereby in respect to a particular installation of the food freezing tunnel, maintenance servicing, via the larger side panels, may all be done along one side of the tunnel, and the smaller side doors for clean out and airflow control and airflow pulsing may be optionally located on one side or the other of the freezing tunnel.

4. An improved food freezing building structure and inside freezing tunnel, as claimed in claim 3, wherein the aligned lower inlet air chamber, the freezing chamber, the defrost chamber, and the powered fan are arranged as a uni-section, and then a selective number of additional uni-sections are added to create a longer food freezing tunnel, with accompanying adjustments in the length of the porous conveyor belt and its conveyor chamber, and wherein in respect to one uni-section all these panels and doors may be closed during its servicing and/or defrosting, while the other uni-sections remain in operation.

5. An improved food freezing building structure and inside freezing tunnel as claimed in claim 4, having vertical plastic food product guards equipped with horizontal plastic runners for placement along the respective sides of a moving porous conveyor belt to keep the food products on and over the porous conveyor belt, these guards being arranged in sections to accommodate their longitudinal expansion and contraction, with these guard sections being fastened together using a fastener assembly, which continues the presentation of only plastic materials to the food portions being kept on and over the porous conveyor belt.

6. An improved food freezing building structure and inside food freezing tunnel, as claimed in claim 1, having a vibratory weir selectively positioned along and over the porous conveyor belt.

7. An improved food freezing building structure and inside food freezing tunnel, as claimed in claim 1, having vertical plastic food product guards equipped with horizontal plastic runners for placement along the respective sides of the moving porous conveyor belt to keep the food products on and over the porous conveyor belt.

8. An improved food freezing building structure and inside food freezing tunnel, as claimed in claim 7, wherein the vertical plastic food product guards are arranged in sections to accommodate their longitudinal expansion and contraction, and the sections are fastened together using a fastener assembly, which continues the presentation of only plastic materials to the food product being kept on and over the porous conveyor belt.

9. An improved food freezing building structure and inside food freezing tunnel, as claimed in claim 1, having a returning porous conveyor belt cleaning assembly comprising a supporting frame extending out from the food freezing building structure in turn supporting in a following on order a washer, a drier, and an auger to remove food products and food debris from the porous conveyor belt, before it returns to receive food portions to be frozen in the freezing tunnel.

10. An improved food freezing building structure and inside freezing tunnel as claimed in claim 1 wherein the aligned lower inlet air chamber, the freezing chamber, the defrost chamber, the fan chamber, and the powered fan are arranged as a uni-section, and then a selective number of additional uni-sections are added to create a longer food freezing tunnel, with accompanying adjustments in the length of the porous conveyor belt and its conveyor chamber.

11. An improved food freezing building structure and inside freezing tunnel, as claimed in claim 10, having access panels for servicing equipment, and doors for clean out and airflow changes, all panels and doors being used effectively to keep most uni-sections operating, while a designated uni-section is not operating during servicing and/or defrosting.

12. An improved food freezing building structure and inside freezing tunnel, as claimed in claim 11, where lubricating grease fittings are installed on the outside of the various chambers with interior grease conduits extending to equipment needing lubrication.

13. An improved food freezing building structure and inside freezing tunnel as claimed in claim 1, having returning air intake doors in the lower inlet air chamber to be selectively adjusted in their opening to control the flow of this returning air into this chamber.

* * * * *